United States Patent [19]

Brandl et al.

[11] Patent Number: 4,576,084

[45] Date of Patent: Mar. 18, 1986

[54] SMALL ARM HAVING A BARREL WITH A TRANSVERSE BORE AND A DETACHABLE SILENCER

[75] Inventors: Rudolf Brandl, Dornhan-Weiden; Helmut Danner, Sulz-Sigmarswanger, both of Fed. Rep. of Germany

[73] Assignee: Heckler & Koxh GmbH, Oberndorf/Neckar, Fed. Rep. of Germany

[21] Appl. No.: 630,080

[22] Filed: Jul. 12, 1984

[30] Foreign Application Priority Data

Jul. 15, 1983 [DE] Fed. Rep. of Germany ..... 3325623
Jul. 15, 1983 [DE] Fed. Rep. of Germany ..... 3325671

[51] Int. Cl.[4] ..... F41C 21/18

[52] U.S. Cl. ..... 89/14.4; 181/223; 181/254

[58] Field of Search ..... 89/14.4; 181/223, 236, 181/254

[56] References Cited

U.S. PATENT DOCUMENTS 4,501,189 2/1985 Brandl et al. ..... 89/14.4

FOREIGN PATENT DOCUMENTS 71799 2/1983 European Pat. Off. .
2911999 10/1979 Fed. Rep. of Germany .

*Primary Examiner*—Stephen C. Bentley

[57] ABSTRACT

A small arm having a barrel (11) with at least one transverse bore (14) and a detachable silencer (62) including an expansion chamber (58) communicating with the transverse bore, comprising selectively operable closure means (34) arranged in the path of the combustion gases between the interior of the barrel and the expansion chamber is characterized by an arrangement in which the closure means (34) is prevented from opening or remaining in the open position when the silencer (62) is not in place. Thus, any risk of injury to the shooter is excluded.

19 Claims, 8 Drawing Figures

34
224
20
23
230
22
46
226
229
29
228
225
227
132
144
136
146
140
98
72
70
94
86

229'
224
23
20'
230
250
226'
260'
228'

SMALL ARM HAVING A BARREL WITH A TRANSVERSE BORE AND A DETACHABLE SILENCER

The present invention relates to a pocket gun having a barrel with at least one transverse bore and a detachable silencer including an expansion chamber communicating with the transverse bore, comprising selectively operable closure means arranged in the path of the combustion gases between the interior of the barrel and the expansion chamber.

A gun of this type has been known substantially from EP-A 0 071 799. The silencer of such guns which are equipped with a silencer comprising an expansion chamber can be detached, at least for cleaning purposes. Such firearms, if not provided with closure means selectively operable by the shooter, offer the disadvantage that when the gun is fired with the silencer removed, this results in a considerable risk of the shooter being injured by the combustion gases which may be discharged through the transverse bore and may hit, for instance, upon the shooter's hand. The same risk exists in the case of the firearm described above if the silencer is detached and the gun must then be fired for some reason or other, and the shooter does not make sure to close the closure means.

Now, it is the object of the present invention to improve a gun of the type described above so that the above-mentioned risks for the shooter will be avoided. According to the invention, this object is achieved by an arrangement in which the closure means is prevented from being opened or from remaining in the open position when the silencer is not in place.

The advantage of the present invention resides in the fact that when the closure means was in its closed position when the silencer was removed, it cannot be opened after the silencer has been detached, and that even if the silencer is removed with the closure means in its open position—if this is not rendered impossible by certain embodiments of the invention described hereafter—the closure means will close during removal of the silencer.

This excludes any escape of combustion gases developed by the ammunition through the transverse bore in case the gun should be fired with the silencer removed.

In one embodiment of the invention, locking means responding to the presence or absence of the silencer are provided which prevent the closure means from being opened when the silencer is not in place. Even if the shooter should try in this case to open the closure means by actuating a handle provided for this purpose, this will prove impossible because either the driving connection between the actuating means and the closure means has been interrupted by the locking means, or else the closure means or the actuator of the closure means is blocked against movement.

Consequently, the closure means cannot be opened when the silencer is not in place.

The embodiment described above may be improved in accordance with another embodiment of the invention by designing the locking means in such a manner that the closure means will be closed when it occupies the open position when the silencer is detached.

In one embodiment of the invention, the silencer is equipped with an element to be actuated for opening the closure means, and a spring which retains the closure means in the closed position when the silencer is not in place.

In this embodiment, the closure means cannot be opened when the silencer has been detached because the element to be operated for opening is mounted on the detached silencer and, accordingly, no longer connected in driving relationship with the closure means. The spring retains the closure means in the closed position for as long as the silencer remains detached and until, after attachment of the silencer, the said element is actuated for opening the closure means. If the silencer can be detached with the closure means in the open position, the said spring will immediately transfer the closure means into the closed position.

In one embodiment of the invention, the design of the locking means is such that it locks the silencer in place when the closure means is in the open position. The advantage of this embodiment lies in the fact that the silencer cannot be removed as long as the closure means remains in the open position, which likewise eliminates any risk of injury.

In one embodiment of the invention, actuator means for operating the closure means are accommodated in a receiver part, which means determine by their position the open or closed condition of the closure means. In addition, a bar is provided which when the silencer occupies its operative position is held by it in a first position in which it permits the actuator means to be operated, and which when the silencer is missing occupies a second position in which it locks the actuator means. This embodiment can have a very simple design and the same time give reliable performance.

One embodiment of the invention provides that the bar coacts with a stop of the silencer when the latter is in its operative position so as to prevent any rotary movement of the silencer which would be necessary for detaching it, and that means for disengaging the bar from the stop are provided. The described rotary movement may be required, in particular, for screwing off the silencer, but may be necessary also when the silencer is connected with the gun via a bayonet catch. The bar of this embodiment is intended primarily to provide safety also against unintentional or unwanted loosening or disengagement of the silencer so that the bar preferably will not assume its inoperative position automatically when the closure means is closed; rather, the means for releasing the bar are preferably so designed that the shooter is required to actuate it especially if he wants to detach the silencer.

The described stop at the silencer preferably may take the form of a toothing provided on the silencer, and this toothing may according to one embodiment of the invention comprise saw-shaped teeth so that when the silencer performs the necessary rotary movement when being attached, the bar is withdrawn by the sloping flanks of the teeth, against the action of a spring which urges it against the toothing, but retained in contact with the locking flanks which extend substantially in axial planes relative to the axis of the silencer when the silencer is rotated in the opposite sense. Consequently, the silencer can be detached only when the bar is disengaged from the locking flanks by the means described before.

In one embodiment of the invention, the actuator means comprise a shaft pivotally mounted on the receiver part and connected in driving relationship with a control disk provided with a recess which is engaged by a projection of the bar when the bar is in its second position (where the silencer is missing or not fully in its operative position) and the actuator means is in the position in which the closure means is closed. In this case, the closure means must be closed before the silencer is detached. The advantage of this embodiment lies in the fact that it provides very simple means for actuating the closure means which can be used also without difficulty and in a simple manner for releasing the rotary movement of the silencer.

In one embodiment of the invention, the said control disk comprises a control cam which causes the closure means to be opened when the control shaft is rotated in a first sense of rotation, starting from a position in which the closure means is closed.

In one embodiment of the invention the control disk is provided with a control cam which acts upon the bar and moves it away from the stop of the silencer when the shaft is rotated from the position in which the closure means is closed in a sense opposite to that required for opening the closure means. In this position, the silencer can then be released. The design of the said control cam is preferable such that when the shooter releases the actuator means, the control cam is returned by the force of the spring acting upon the bar into that position in which the bar engages the before-mentioned recess in the control disk when the silencer is not in place, to prevent the control disk from being rotated in the sense in which the closure means opens.

In one embodiment of the invention, a catch bolt is slidably guided on the bar whose end can be brought into engagement with different recesses in the shaft associated with certain stop positions of the shaft. This embodiment offers a simple design and permits the shaft to be retained in different positions which is felt advantageous in handling the gun.

In one embodiment of the invention, the catch bolt can be displaced substantially in the same direction in which the bar moves when locking and releasing the silencer.

The catch bolt could be driven also by a separate spring. But it is provided in one embodiment of the invention that the spring urging the bar against the projection of the silencer bears with one of its ends against the bar and with the other one against the catch bolt. So, a single spring is required only to load the two parts (bar and catch bolt).

In one embodiment of the invention in which, as in the printed publication mentioned at the outset, the closure means comprises a bolt mounted movably in a bore, with the bore opening up on one end in the form a funnel and the bolt being provided on the same end with a valve disk adapted to this funnel-shaped enlarged portion, it is provided that the bolt is slidably guided, that it is subjected to the action of a spring urging it into the closed position and that the actuator means is connected with the bolt in driving relationship. The bolt of the printed publication mentioned at the outset is screwable rather than displaceable, so that it can be transferred between the opening position and the closing position merely by a rotary movement about is longitudinal axis.

In one embodiment of the invention, the driving device is connected with the bolt via a two-armed lever. This permits a very space-saving arrangement of the driving means for the bolt which will normally extend substantially transversely to the longitudinal axis of the barrel.

The invention also relates to a preferably automatic small arm whose barrel is connected with a bolt stop via a bolt link mounted in the bolt stop and projecting into a recess in the barrel. In a known firearm of this type, the automatic G3 rifle, the barrel has its rear end portion press-fitted in the bolt stop, and a pin extending transversely to the longitudinal direction of the barrel is fitted in a bore extending through both, the bolt stop and the barrel, so that the pin provides a positive connection, in addition to the press fit. It is not possible in the case of the known firearm to change the barrel without the aid of a specialized workshop. Now, it is the object of the present invention to provide firearm of this type whose barrel can be changed without any special tools. This object is achieved in that the bolt link is designed as threaded bolt an end portion of which engages a matching recess in the barrel. The threaded bolt extends preferably in a radial direction relative to the barrel. The connection between the barrel and the stop bolt is realized by a close sliding fit.

Other features and advantages of the invention will be apparent from the claims and the following description of certain embodiments of the invention when read with reference to the drawing which shows certain features essential to the invention, it being understood that the individual features may be used in any embodiment of the invention either alone or in any desired combination. In the drawing:

Figure 1:
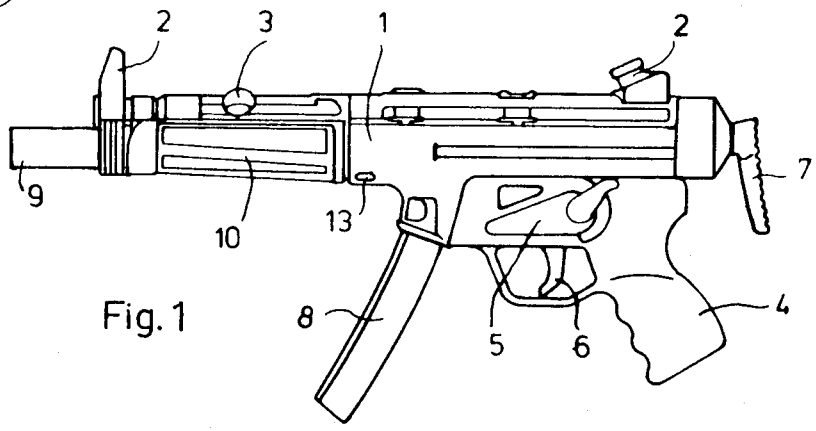
FIG. 1 shows a side view of a gun according to the invention.

The submachine gun shown in FIG. 1 comprises a receiver 1 with a handguard 10 covering the barrel, a sight 2 and a loader 3. Further, the gun comprises a pistol grip 4 with a trigger assembly housing 5 and a trigger 6, as well as a shoulder stock 7, a box magazine 8 and a muzzle silencer 9. A gun having the appearance of the gun shown in FIG. 1 and comprising the before-mentioned parts, except for the change lever 13, has been known from the printed publication mentioned at the outset.

Figure 2:
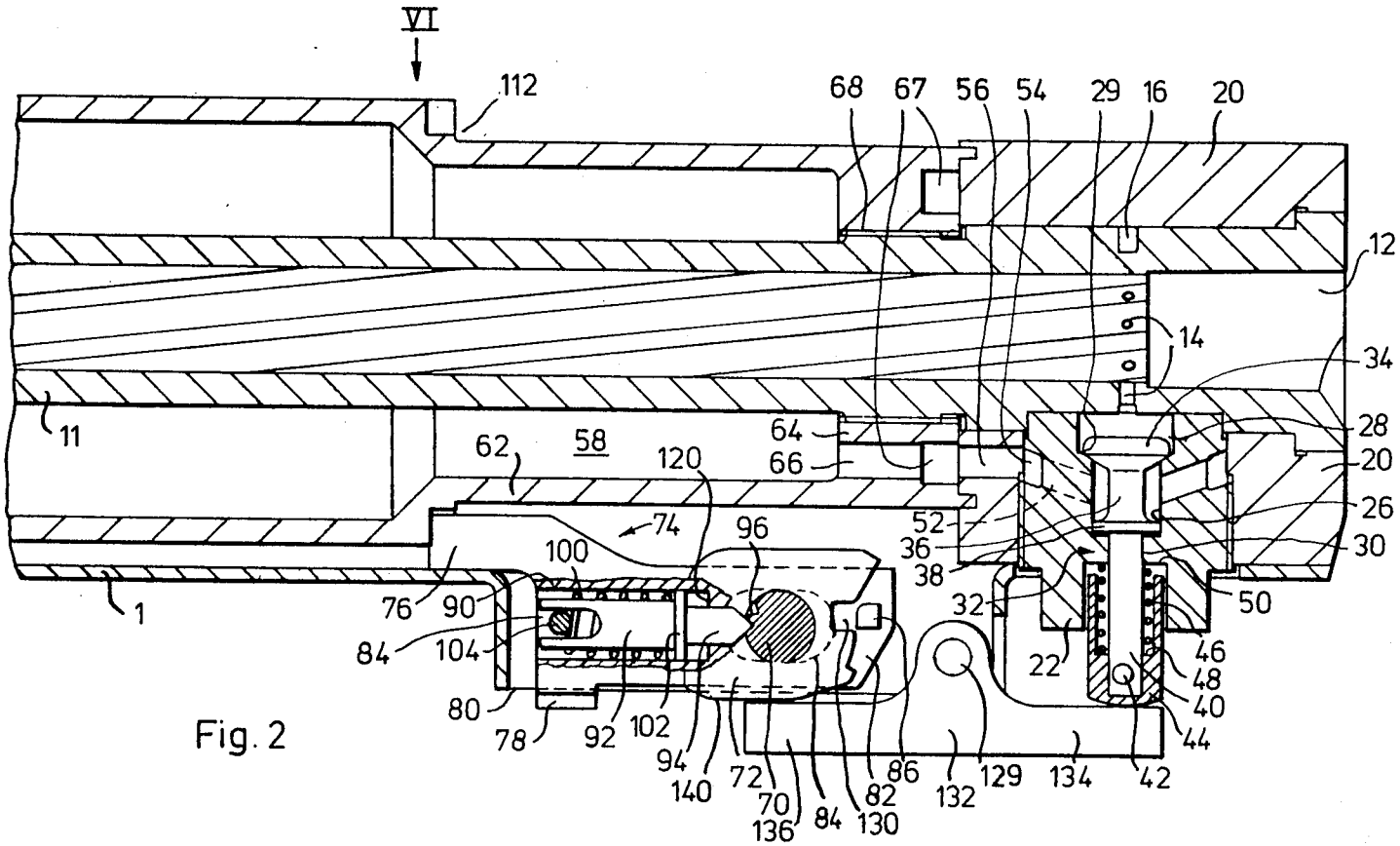
FIG. 2 is a longitudinal section through part of the barrel and the adjacent parts of the silencing device of a firearm in accordance with FIG. 1, with the closure means in the closed position.

As can be seen in FIG. 2, a barrel 11 comprises at its rear a chamber 12 which is closed by a bolt stop not shown in the drawing, similar to that described in the before-mentioned printed publication. The barrel is provided, at a small distance from the chamber 12, with closely spaced transverse bores 14 extending through the barrel wall and opening into an annular channel 16 provided on the outside of the barrel 11. A threaded bushing 22 is screwed into a barrel extension 20 which is fixed relative to the chamber 12, with the longitudinal axis of the said threaded bushing 22 extending radially to the barrel 11.

The threaded bushing 22 is provided with an outer thread 23 over a length corresponding to approx. $\frac{2}{3}$ of the thickness of the barrel extension 20. The end portion of the threaded bushing 22 facing the barrel has a plain cylindrical outer surface 224 which fits exactly into a cylindrical bore 225 in the barrel extension 20. The inner cylindrical end portion 226 of the threaded bushing 22 projects into an exactly matching cylindrical bore 227 which extends a short length into the barrel 11 and whose diameter is slightly smaller than the diameter of the bore 225. The inner end face 228 of the threaded bushing 22 rests against an end face 229 of the barrel 11 delimiting the bore 225. The end face 228 is annular in shape. Considering that the outer diameter of the threaded bushing 22 is substantially as big in the example described as the outer diameter of the barrel 11, it goes without saying that the end face 228 cannot rest with its full surface on the end face 229 of the barrel 11. By the arrangement just described, the barrel 11 is held in an exactly defined position by the threaded bushing 22, and is firmly retained in the barrel extension 20. The threaded bushing 22 is provided with flat faces 230 for the application of a fork spanner so that it can easily be unscrewed. Consequently, the barrel can be exchanged easily as it is mounted in the barrel extension by way of a close slide fit.

The threaded bushing 22 comprises a bore which has a substantially central and upper portion—as viewed in FIG. 2—in the form of a plain bore 26 while the portion adjacent the barrel 11 tapers outwardly to form a funnel-shaped space 28. The tapering face is marked by the reference number 29. At its lower end, the plain bore 26 is followed by a plain bore 30 of smaller diameter. The bores 26, 30 accommodate a bolt 32 provided with a valve disk 34 which has a diameter larger than that of the bore 26 and which in the position shown in the drawing bears against the funnel-shaped face 29. The valve disk 34 is followed by a reduced portion 36 so that the bolt exhibits in this area a diameter smaller than that of the bore 26. The portion 36 of the bolt 32 is followed by a portion 38 of a diameter equal to that of the bore 26, the portion 38 performing at the same guiding and sealing functions. The portion 38 of the bolt ends in a portion 40 of a diameter matching that of the bore 30. The bolt 40 projects outwardly beyond the threaded bushing 22. The portion 40 carries a downwardly closed tubular sleeve 44 mounted thereon by means of a key bolt and having a diameter larger than the outer diameter of the portion 40. The space thus formed between the tubular sleeve 44 and the portion 40 accommodates a helical pressure spring 46 bearing with its one end against a supporting face 48 of the sleeve 44 and with its other end against a face 50 of the threaded bushing 22, thus tending to urge the valve disk 34 constantly against the face 29.

The bore 26 communicates via five radially arranged bores 52 with an annular channel 54 provided on the outside of the threaded bushing 22 which in turn communicates with a bore 56 passing through the barrel extension 20 and establishing the connection with an expansion chamber 58. The expansion chamber 58 is delimited by the outer face of the barrel 11, and a tubular part 62 comprising an end wall pierced by one (or more) channel(s) 66 opening into an annular channel 67 communicating with the bore 56. The tubular part 62 is fixed undetachably to the muzzle silencer 9. The complete muzzle silencer arrangement comprising the muzzle silencer and the expansion chamber is screwed to the barrel 11 near the chamber 12 by means of a thread 68 and can, thus, be detached. The thread 68 is a conventional right-hand thread.

Figure 7:
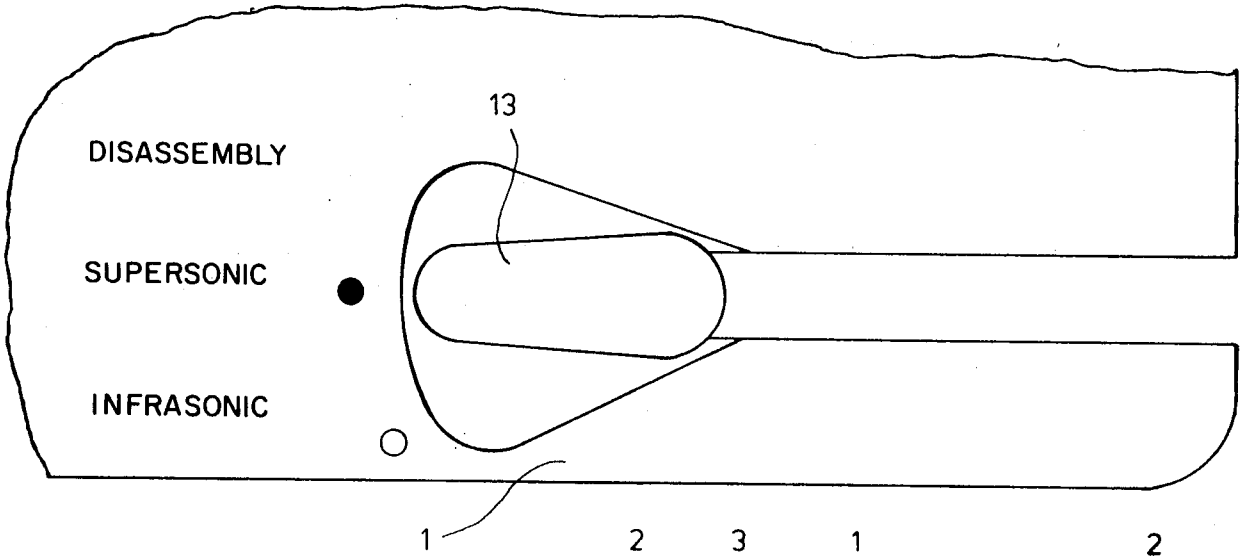
FIG. 7 is a view of the actuator means for the closure means arranged at the outside of the receiver of the gun.

A shaft 70 mounted pivotally in the receiver 1 is connected in driving relationship with the lever 13 (FIGS. 1 and 7). The shaft 70 is further connected in driving relationship with a control disk 72 whose plane extends parallel to the drawing plane of FIG. 2. A bar 74 comprises a finger 76 pointing forwardly, i.e. to the left in FIG. 2, further an angle 78 which projects downwardly beyond the receiver 1 and rests against a lower end face 80 to form a guide for the bar 74, and a rear portion 82 which is partly covered in FIG. 2 by the control disk 72 and which comprises an oblong hole 80 serving as passage for the shaft 70 which, thus, also helps guide the bar so that the bar 74 can be displaced in a direction parallel to the longitudinal direction of the barrel 11. The rear portion 82 of the bar 74 carries a stop 86 projecting at a right angle relative to the drawing plane of FIG. 2 and into the plane of the control disk 72.

The bar 74 is provided with a bore 90 which is open at the front and extends in parallel to the longitudinal axis of the barrel 11. A catch bolt 92 whose rear end is pointed to form a catch lug bearing against the outer face of the shaft 70 is movably guided within the said bore 90. The shaft 70 is provided with two wedge-shaped recesses 96 and 98 matching the shape of the catch lug 94, and in two of the totally three angular positions which the shaft 70 is able to assume the catch lug 94 is in engagement with one of the said recesses 96 or 98 to retain the shaft 70 in the respective angular position. By actuating the lever 13, the shooter may, however, change the angular position of the shaft 70. Accordingly, the catch lug 94 and the recesses 96 and 98 form together a ratchet mechanism.

Figures 3, 8:
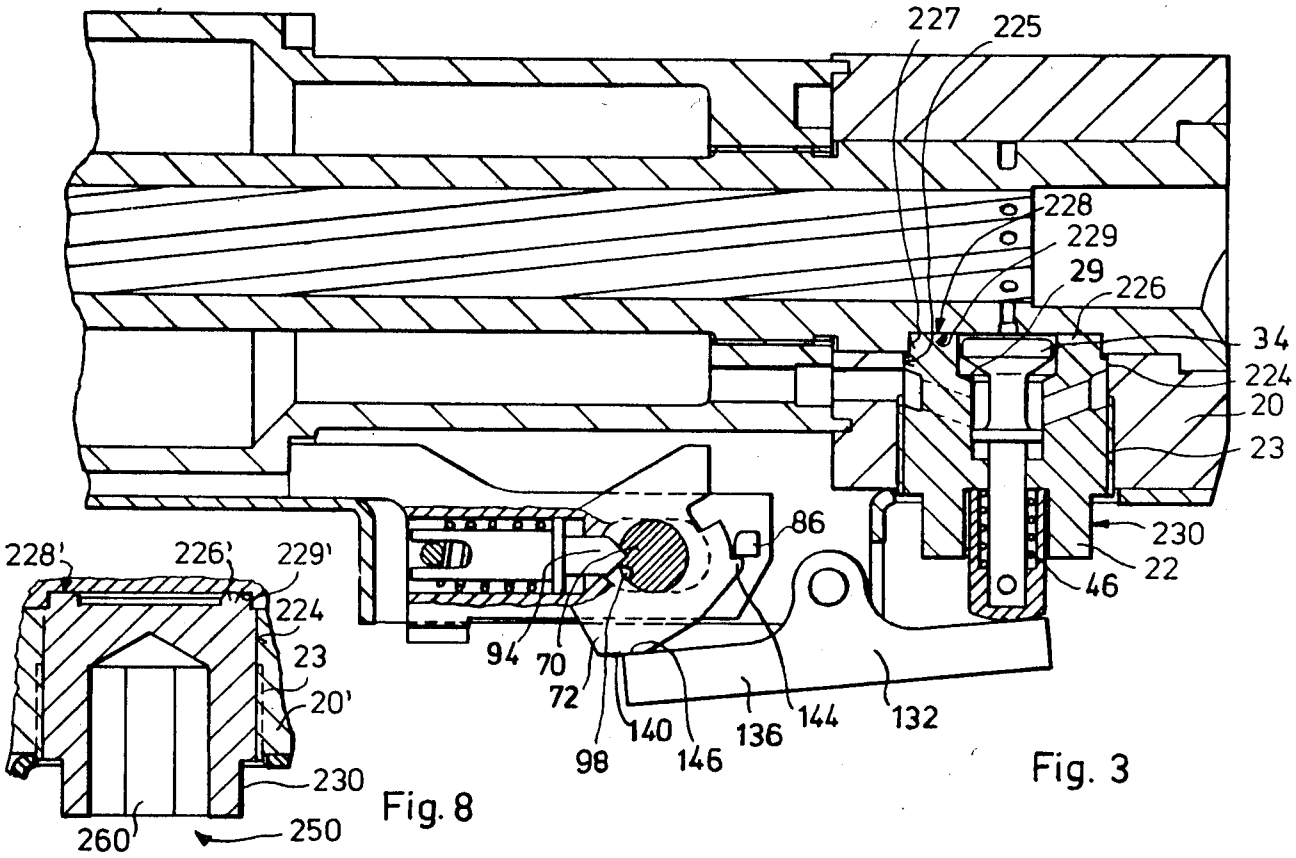
FIG. 3 is a representation corresponding to FIG. 2, with the closure means in the open position.
FIG. 8 shows a longitudinal section through a threaded bolt.
Figure 5:
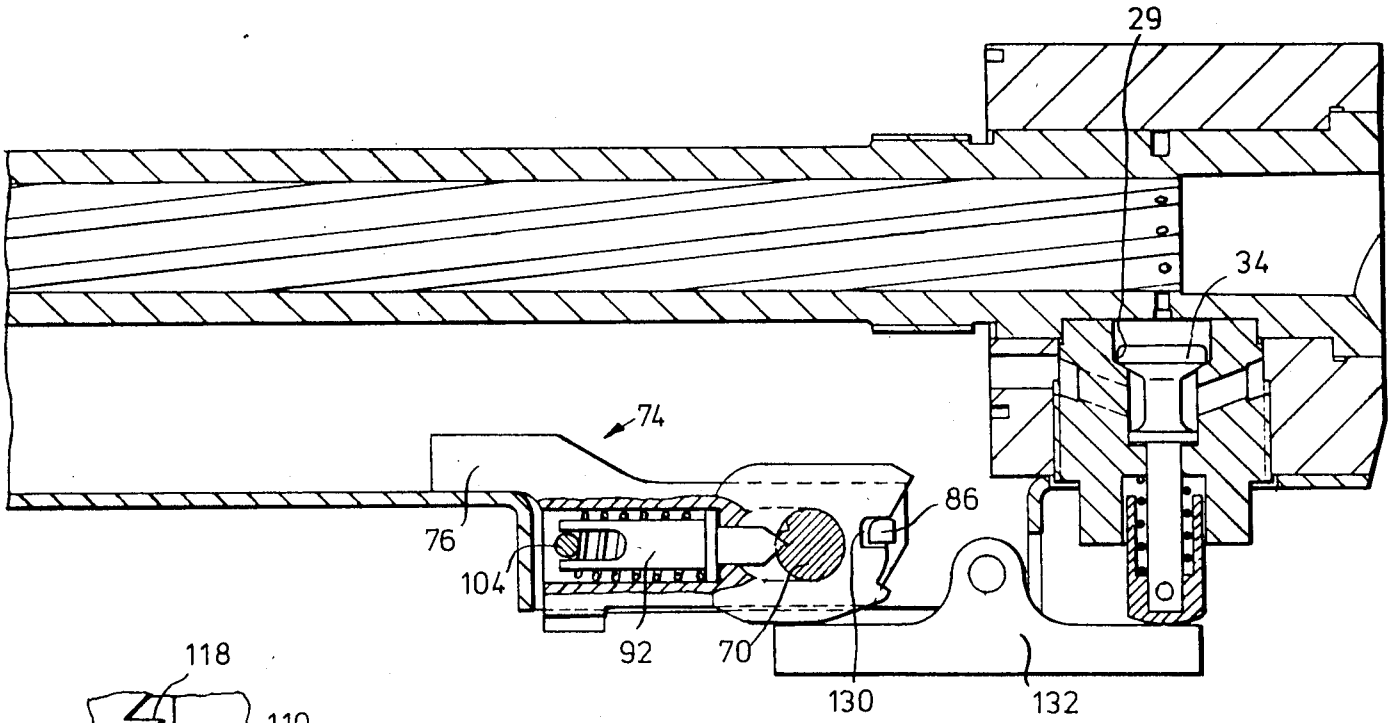
FIG. 5 is a representation corresponding to FIG. 2, with the silencer detached.
Figure 6:
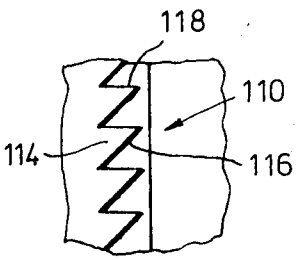
FIG. 6 is a view of the toothing of the silencer, viewed in the direction indicated by arrow VI in FIG. 2.

The catch bolt 92 is urged against the shaft 70 by a helical pressure spring 100 bearing with its one end against a supporting face 102 of the catch bolt and with its other end against a bolt 104 passing through the bore 90 and fixed in the bar 74. To this end, the forward movement of the bar 74 must be delimited by an abutment. In FIGS. 2 and 3, this abutment is provided by the finger 76 of the bar 74 bearing against a saw-shaped toothing 110 provided in an area 112 of the tubular part 62 where the latter increases in diameter. Each of the teeth 114 of the toothing 110 comprises a sloping flank 116 and a steep flank 118 extending in a radial plane relative to the barrel 11. Due to the fact that the catch bolt 92 bears against the shaft 70, the finger 76 is urged resiliently against the toothing 110 by the spring 100. Now, when the silencer, after having been detached from the gun, is to be screwed on and rotated to this end in clock-wise direction, the sloping flanks 116 will urge the finger 76 back against the action of the spring 100 as soon as they get into contact with the finger 76. But as long as the finger 76 occupies its position shown in FIG. 2, the silencer cannot be unscrewed in the opposite direction because the finger 76 will in this case abut against one of the steep flanks 118 and cannot be brought out of engagement with the latter by turning the silencer. Thus, the bar 74 forms together with the toothing a mechanism which acts as a ratchet mechanism when the silencer is being screwed on and as a locking mechanism when any attempt it made to unscrew the silencer. When the silencer is not in place, the rear end face of the oblong hole 84 rests against the shaft 70 thus delimiting the movement of the bar 74 in the forward direction. Consequently, the spring 100 can continue to keep the catch bolt 92 in contact with the shaft 70. FIG. 5 shows this position assumed by the arrangement when the silencer is removed.

A two-armed lever 132 whose two arms 134 and 136 have substantially the same effective length is pivotally mounted on a bearing pin 130 extending at a right angle to the drawing plane of FIG. 2 and fixed in the receiver 1. The rearwardly pointing arm 134 rests against the lower end of the sleeve 44 while the forwardly pointing arm 136, though extending in the same plane as the disk cam 72, is a little spaced from the latter in the position shown in FIG. 2 in which the valve disk 34 bears against the face 29.

In the position shown in FIG. 2, in which the silencer is completely mounted and the valve 34, 29 closed, no combustion gases are permitted to penetrate into the expansion chamber 58 through the bores 14 when the gun is fired. Thus, the firing energy is not diminished and, provided a suitable ammunition is used, the bullet will leave the gun at supersonic velocity. The muzzle silencer 9 acts to reduce the noise to some degree in the immediate neighborhood of the gun.

Starting from the position shown in FIG. 2, by shifting the lever 13 (FIGS. 1 and 7) downwardly, the shooter can turn the control disk 72 in FIG. 2 in counter-clockwise direction because the stop 86 does not engage the recess 130. When the control disk 72 is turned in this manner, its cam face 140 acts upon the upside of the forward arm 136 of the two-armed lever 132 to shift it in counter-clockwise direction whereby the rear arm 134 raises the valve disk 34. In this position, which is shown in FIG. 3, a certain part of the combustion gases developed by the propellant charge of the ammunition escapes through the bores 14 into the expansion chamber 58 when a shot is fired. This reduces the pressure of the propellant gases in the barrel so that the bullet leaves the barrel at subsonic velocity only which avoids the supersonic boom. Since the muzzle silencer acts also to dampen the muzzle blast, the noise of the gun is very efficiently reduced in this position of the valve.

In the position of the control disk 72 shown in FIG. 3, the latter is also retained by the catch lug 94 which engages the peripheral recess 96 in the shaft 70 in order to secure the shaft 70 in its angular position. The angular movement which the shaft 70 is permitted to perform from the position shown in FIG. 2 to that shown in FIG. 3 is delimited by the abutment of a stop 144 projecting radially from the control disk 72 against the stop 86.

The pressure spring 46 acts upon the lever 132 to move it in clockwise direction. Since the force exerted mainly in vertical direction upon the control disk 72 acts upon a relatively short lever arm only, i.e. upon a point 146 spaced only a short way in the forward direction from the axis of the shaft 70, the force exerted by the arm 136 does not suffice to push the catch bolt 92 back and to turn the control disk 72 in clockwise direction.

If necessary, the shooter may return the closure mechanism from the position shown in FIG. 3 to the position shown in FIG. 2 by actuating the lever 13.

Starting from the position shown in FIG. 2, the shooter may shift the lever upwardly to permit the silencer to be detached from the gun.

Figure 4:
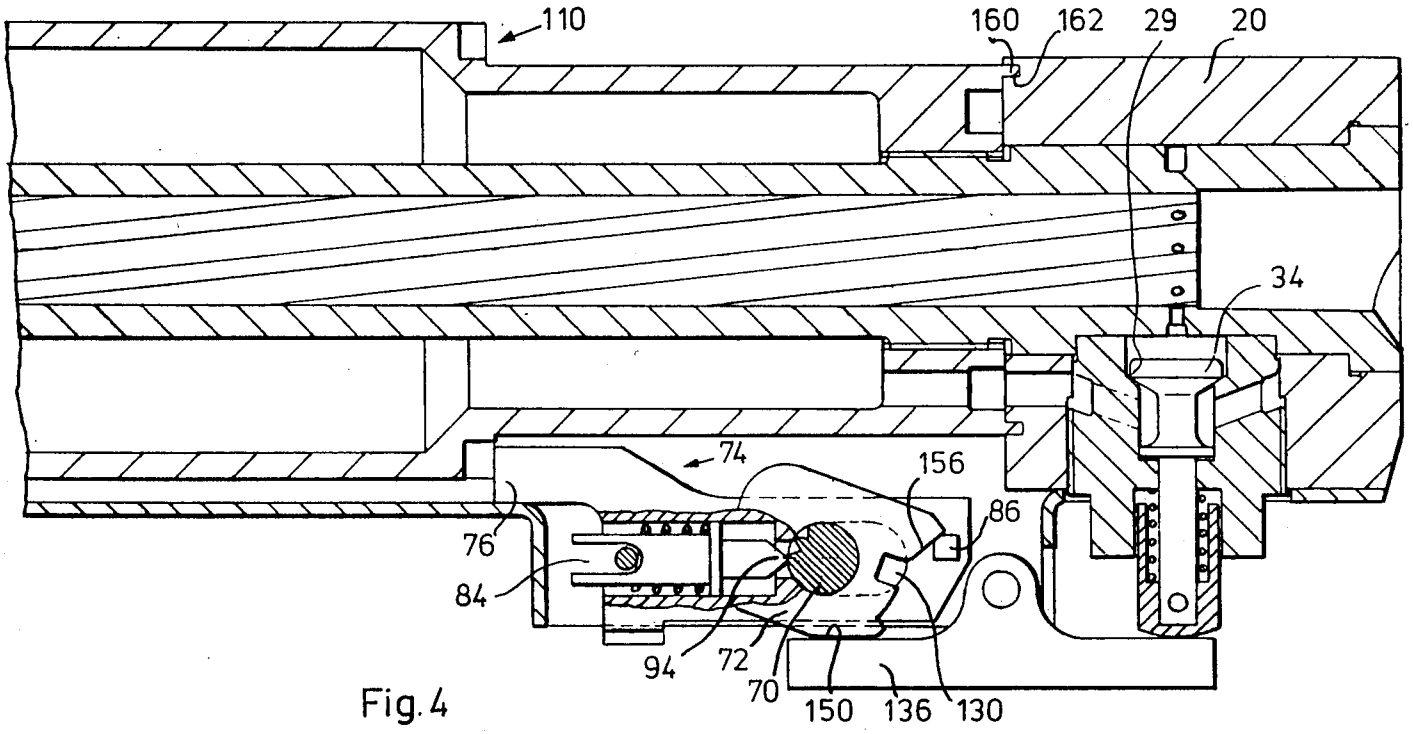
FIG. 4 is a representation corresponding to FIG. 2 in the position in which the silencer can be detached.

The pivotal movement thus effected does not cause the lever 132 to be shifted because the portion 150 of the edge of the control disk 72 opposite the arm 136 has a correspondingly small distance from the axis of the shaft 70. But when the control disk performs this pivotal movement in clockwise direction, an inclined face 156 provided upwardly of the peripheral recess 130 and adjacent thereto comes to rest against the projection 86. The inclined face 156 forms together with the said projection 86 a wedge drive which causes the bar 74 to be displaced rearwardly until it occupies the position shown in FIG. 4. In this position, the forward edge of the oblong hole 84 rests against the shaft 70. The length of the backward displacement is great enough to bring the finger 76 out of engagement with the toothing 110. Now, the silencer can be unscrewed. In the position which the control disk occupies in FIG. 4, the valve disk 34 also rests against the face 29 which means that the gun is set to firing at supersonic velocity. In the position shown in FIG. 4, the catch lug 94 does not retain the shaft 70 in its position.

When the shooter has detached the silencer, he releases the lever 13. As a result thereof, the control disk 72 together with the shaft 70 are returned to their positions shown in FIG. 2 by the action of the spring 100 which pushes the bar 74 forwards because the stop 86 exerts a corresponding torque upon the inclined face 156 provoking this return movement. Since when the silencer is not in place there is no stop to retain the bar in the position shown in FIG. 2, the bar is moved on into the position shown in FIG. 5 in which the projection 86 engages the peripheral recess 130 thus preventing any displacement of the control disk from the position shown in FIG. 5 as long as the silencer is not screwed home far enough to bring the stop 86 out of engagement with the peripheral recess 130. The arrangement is such that the stop 86 will be completely out of engagement with the peripheral recess 130 only when the silencer has been screwed on almost completely so that the combustion gases will be prevented from escaping between the rear end portion of the wall 64 and the forward end of the channel 56, either completely or at least to a degree that excludes any operational trouble or risk of injury. This effect is assisted also by an annular projection 160 provided on the silencer entering an annular groove 162 in the barrel extension 20 in the manner known from the printed publication mentioned at the outset.

In the embodiment shown, the arms 134 and 136 of the two-armed lever 132 which may also be termed a rocker, are equally long. In other embodiments of the invention, however, the length of the arms may be different. It is for example possible to make the forward arm 136 much longer than in the example shown in the drawing and to have it coact with a control disk which may be rotatabe relative to the silencer and fitted on the outside thereof, and may in particular be fitted on a rotary ring seated on the silencer, in which case the shaft 70, the control disk 72 and the bar 74 can be dispensed with. The control disk of this variant will come into engagement with the extended arm 136 only when the silencer has been screwed home sufficiently far (i.e. until the risk of injury by escaping gases is excluded). Then the two-armed lever can be pivoted and the valve disk 34 can be lifted off the face 29 by turning the said control disk. When the silencer is unscrewed, the forward arm of the two-armed lever is no longer supported, and the valve disk 34 resumes its closed position.

FIG. 8 shows a threaded bolt 250 substantially equal to the threaded bushing 22 as regards its outer thread, its end face 228', the cylinder faces 224, the cylindrical end portion 226', and the outer flat faces 230. In addition, the threaded bolt 250 comprises a hexagonal recess 260 so that it can be turned also by means of a hexagon spanner. The threaded bolt 250 lends itself for the easily detachable attachment of the barrel of such rifles the barrel of which does not have any radial bores 14, as in this case no closure mechanism is required. But in case of emergency, the threaded bolt may also be used for repair purposes. Even when the threaded bolt 250, instead of the threaded bushing 22, is used on a rifle in accordance with FIG. 2 the rifle is still ready to be fired and the combustion gases still cannot escape through the radial bores 14.

The reference numbers used in the claims are not to be understood as limitation, but are meant only to facilitate the reader's understanding.

We claim:

1. A small arm having a barrel (11) with at least one transverse bore (14) and a detachable silencer (9, 62) including an expansion chamber (58) communicating with the transverse bore, comprising selectively operable closure means (34) arranged in the path of the combustion gases between the interior of the barrel and the expansion chamber, characterized by an arrangement in which the closure means (34) is prevented from being opened or from remaining in the open position when the silencer (9, 62) is not in place.

2. A firearm in accordance with claim 1, characterized in that locking means (74) responding to the presence or absence of the silencer (9, 62) are provided which prevent the closure means (34) from being opened when the silencer is not in place.

3. A firearm in accordance with claim 2, characterized in that the locking means are designed in such a manner that the closure means will be closed when it occupies the open position when the silencer is detached.

4. A firearm in accordance with claim 1, characterized in that the silencer is provided with an element to be actuated for opening the closure means and that a spring is provided which retains the closure means in the closed position when the silencer is not in place.

5. A firearm in accordance with claim 2, characterized in that the design of the locking means (72, 74, 220) is such that it locks the silencer in place when the closure means is in the open position.

6. A firearm in accordance with claim 2, characterized in that actuator means (10, 70, 72) for operating the closure means are accommodated in a receiver part (1), which means determine by their position the open or closed condition of the closure means, that a bar (74) is provided which when the silencer (9, 62) occupies its operative position is held by it in a first position in which it permits the actuator means to be operated, and which when the silencer is missing occupies a second position in which it locks the actuator means.

7. A firearm in accordance with claim 6, characterized in that the bar (74) coacts with a stop (110) of the silencer (9,62) when the latter is in its operative position so as to prevent any rotary movement of the silencer which would be necessary for detaching it, and that means for disengaging the bar from the stop are provided.

8. A firearm in accordance with claim 7, characterized in that the projection is part of a toothing (110) of the silencer (9, 62).

9. A firearm in accordance with claim 8, characterized in that the bar (74) is retained in engagement with the toothing (110) by a spring (100) and that the toothing comprises saw-shaped teeth (114) so that when the silencer performs the necessary rotary movement when being attached, the bar is withdrawn by the sloping flanks (116) of the teeth (114), against the action of a spring, but retained in contact with one of the locking flanks (118) of the teeth (114), which extend substantially in axial planes, when the silencer (9, 62) is rotated in the opposite sense.

10. A firearm in accordance with claim 6, characterized in that the actuator means comprise a shaft (70) pivotally mounted on the receiver part (1) and connected in driving relationship with a control disk (72), and that the control disk is provided with a recess (130) which is engaged by a projection (86) of the bar (74) when the bar is in its second position and the actuator means is set to the position in which the closure means is closed.

11. A firearm in accordance with claim 10, characterized in that the control disk comprises a control cam (140) which causes the closure means (34) to be opened when the control shaft is rotated in a first sense of rotation, starting from a position in which the closure means is closed.

12. A firearm in accordance with claim 10, characterized in that the control disk (72) comprises control cam (156) which acts upon the bar (74) to move the bar away from the stop (110) of the silencer (9, 62) when the shaft is rotated from the position in which the closure means is closed in the sense of rotation opposite to that required for opening the closure means.

13. A firearm in accordance with claim 6, characterized in that a catch bolt (92) is slidably guided on the bar (74) whose end can be brought into engagement with recesses (96, 98) in the shaft defining stop positions of the shaft (70).

14. A firearm in accordance with claim 13, characterized in that the catch bolt (92) can be displaced substantially in the same direction in which the bar moves when locking and releasing the silencer (9, 62).

15. A firearm in accordance with claim 9, characterized in that a catch bolt (92) is slidably guided on the bar (74) whose end can be brought into engagement with recesses (96, 98) in the shaft defining stop positions of the shaft (70) and that the spring (100) bears with its ends against the bar (74) on the one hand and the catch bolt (92) on the other hand.

16. A firearm in accordance with claim 1 in which the closure means comprises a bolt (32) mounted movably in a bore (26), with the bore opening up on one end in the form of a funnel (29) and the bolt being provided on the same end with a valve disk (34) adapted to this funnel-shaped enlarged portion, characterized in that the bolt (32) is slidably guided, that it is subjected to the action of a spring (46) urging it into the closed position and that the actuator means (10, 70, 72, 132) is connected with the bolt in driving relationship.

17. A firearm in accordance with claim 16, characterized in that the drive mechanism is connected with the bolt (32) in driving relationship via a two-armed lever (132).

18. A firearm in accordance with claim 1, characterized in that locking means responding to the presence or absence of the silencer (9, 62) are provided and that the design of the locking means (72, 74, 110) is such that they block the silencer in place when the closure means is open.

19. A firearm in accordance with claim 1, characterized in that the closure means (34) are provided in a threaded bushing (22) whose axis extends substantially radially to the barrel (11) and which mounts the barrel (11) detachably in a barrel extension (20).

* * * * *